US007448675B1

(12) United States Patent
Lowery

(10) Patent No.: US 7,448,675 B1
(45) Date of Patent: Nov. 11, 2008

(54) COMFORT DEVICE

(76) Inventor: Jimmy L. Lowery, 1036 Shubuta Dr., Lugoff, SC (US) 29078

( * ) Notice: Subject to any disclaimer, the term of this patent is extended or adjusted under 35 U.S.C. 154(b) by 0 days.

(21) Appl. No.: 11/668,432

(22) Filed: Jan. 29, 2007

(51) Int. Cl.
*A47C 7/62* (2006.01)

(52) U.S. Cl. ..... 297/188.14

(58) Field of Classification Search ..... 297/188.14, 297/188.1, 411.46, DIG. 1; 224/275; D12/421, D12/416; 248/311.2; 220/902
See application file for complete search history.

(56) References Cited

U.S. PATENT DOCUMENTS 2,524,659 A * 10/1950 Gorman ..... 297/411.24
2,668,582 A 2/1954 Goodfellow
2,704,114 A 3/1955 Williams
3,951,448 A * 4/1976 Hawie ..... 297/113
5,104,182 A * 4/1992 Rasnick et al. ..... 297/113
5,303,976 A * 4/1994 Nobile et al. ..... 297/146
5,337,984 A * 8/1994 Houck ..... 248/146
5,511,755 A * 4/1996 Spykerman ..... 248/311.2
5,842,743 A * 12/1998 Wright et al. ..... 297/378.1
5,911,472 A 6/1999 Toth
D431,944 S 10/2000 Cazarez et al.
6,343,835 B1 2/2002 Ledbetter
7,213,885 B2 * 5/2007 White et al. ..... 297/440.1
2007/0013214 A1 * 1/2007 Pope ..... 297/188.14

* cited by examiner

*Primary Examiner*—Milton Nelson, Jr.

(57) ABSTRACT

A comfort device that includes a base, a pair of beverage holders, and a pair of slots that are attached to the beverage holders. The base is rectangularly-shaped and is fabricated from a foam rubber pad. A padded arm rest is located on the top of the foam rubber pad. In addition, a pair of beverage holders are located on the top surface of the padded arm rest, with a pair of slots also being located on the top surface of the padded arm rest. Each slot is adjacent to and is connected to a beverage holder, with the slots being ideal for holding a remote control or other similar object.

8 Claims, 3 Drawing Sheets

COMFORT DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved comfort device that includes a base, a pair of beverage holders, and a pair of slots that are attached to the beverage holders.

DESCRIPTION OF THE PRIOR ART

U.S. Pat. No. 5,911,472, issued to Toth, discloses an armrest construction for sofas having a cushioned sofa back and a plurality of seat cushions.

U.S. Pat. No. 2,704,114, issued to Williams, discloses an armrest and ash receptacle that may be placed on a couch, sofa, vehicle seat, or the like in a convenient manner.

U.S. Pat. No. 2,668,582, issued to Goodfellow, discloses a vehicle seat arm rest that is a portable, adjustable, collapsible and well upholstered unit.

U.S. Pat. No. D431,944, issued to Cazarez et al., discloses an ornamental design for a mobile arm rest for use with motor vehicles and in the home.

U.S. Pat. No. 6,343,835, issued to Ledbetter, disclose a console for holding drinks, food articles, and accessories such as remote controls and the like.

SUMMARY OF THE INVENTION

The present invention concerns that of a new and improved comfort device that includes a base, a pair of beverage holders, and a pair of slots that are attached to the beverage holders. The base is rectangularly-shaped and is fabricated from a foam rubber pad. A padded arm rest is located on the top of the foam rubber pad. In addition, a pair of beverage holders are located on the top surface of the padded arm rest, with a pair of slots also being located on the top surface of the padded arm rest. Each slot is adjacent to and is connected to a beverage holder, with the slots being ideal for holding a remote control or other similar object.

There has thus been outlined, rather broadly, the more important features of a comfort device that the detailed description thereof that follows may be better understood and in order that the present contribution to the art may be better appreciated. There are, of course, additional features of the comfort device that will be described hereinafter and which will form the subject matter of the claims appended hereto.

In this respect, before explaining at least one embodiment of the comfort device in detail, it is to be understood that the comfort device is not limited in its application to the details of construction and to the arrangements of the components set forth in the following description or illustrated in the drawings. The comfort device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present comfort device. It is important, therefore, that the claims be regarded as including such equivalent constructions insofar as they do not depart from the spirit and scope of the present invention.

It is therefore an object of the present invention to provide a comfort device which has all of the advantages of the prior art and none of the disadvantages.

It is another object of the present invention to provide a comfort device which may be easily and efficiently manufactured and marketed.

It is another object of the present invention to provide a comfort device which is of durable and reliable construction.

It is yet another object of the present invention to provide a comfort device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
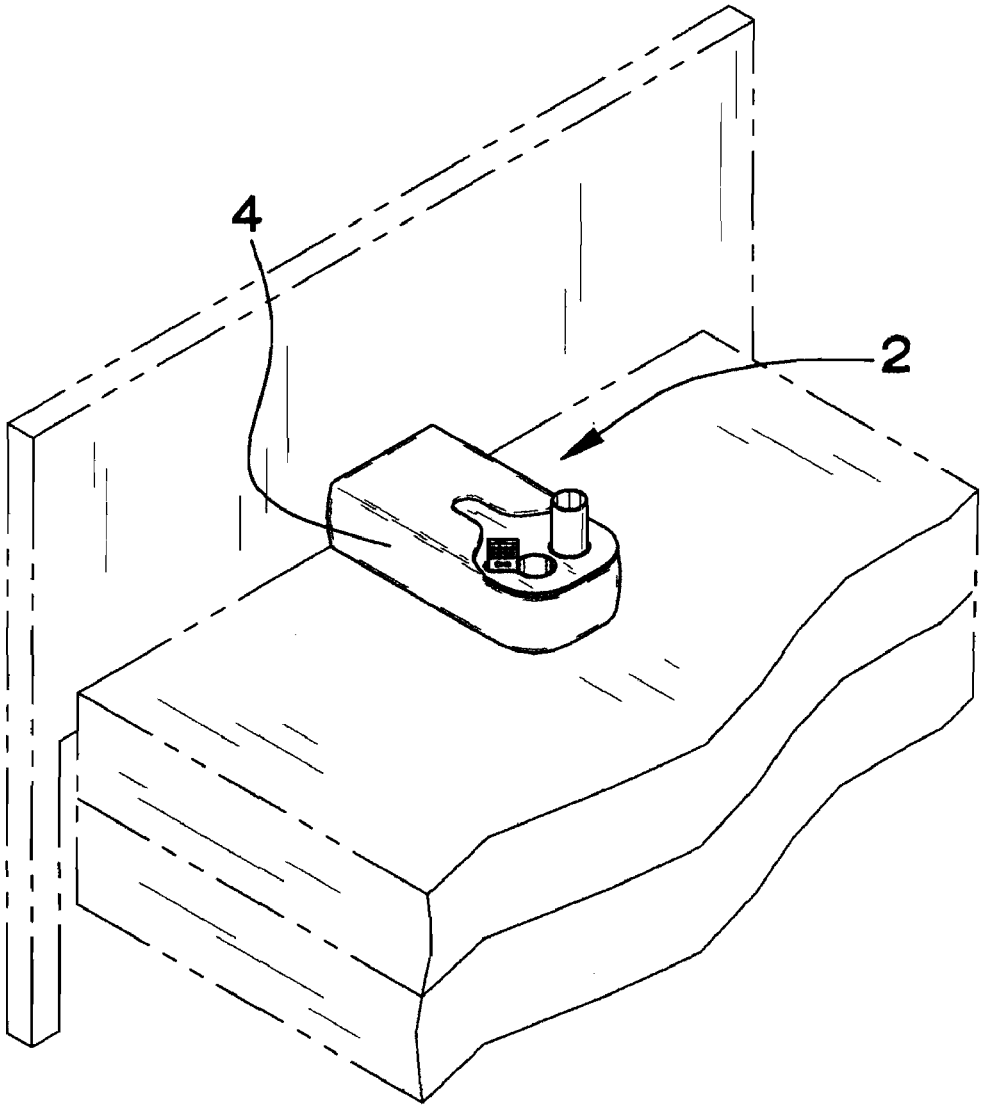
FIG. 1 shows a perspective view of the comfort device as it would appear in use on a bed.
Figure 2:
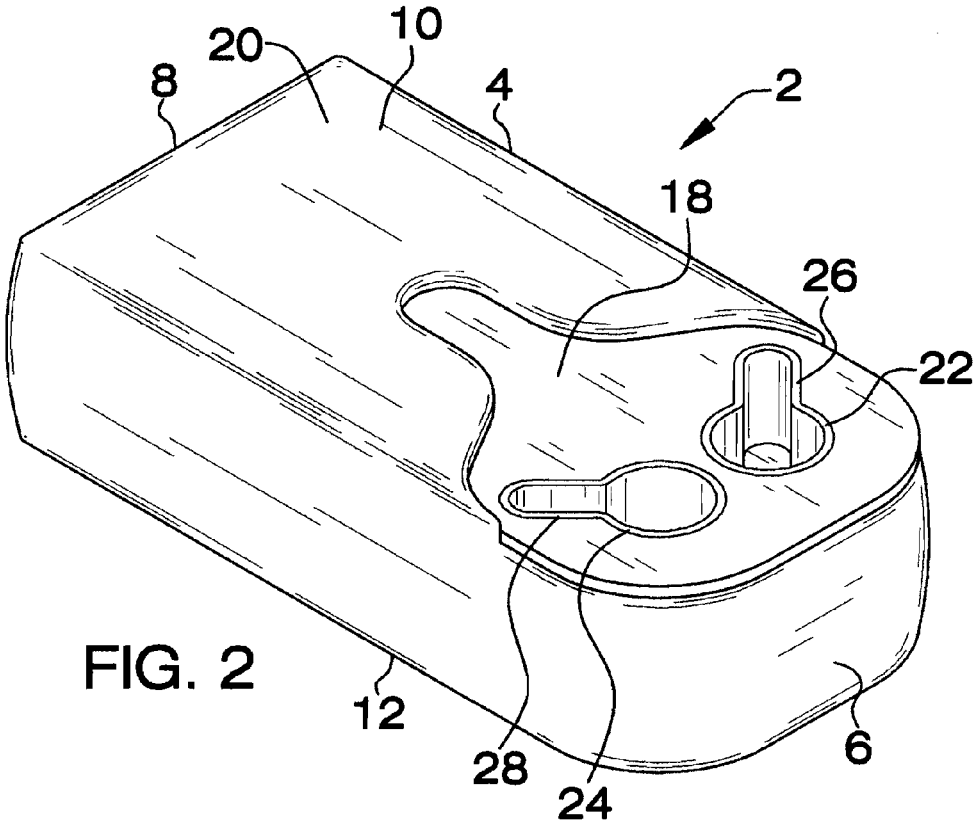
FIG. 2 shows a perspective view of the comfort device as it would appear in use.
Figure 3:
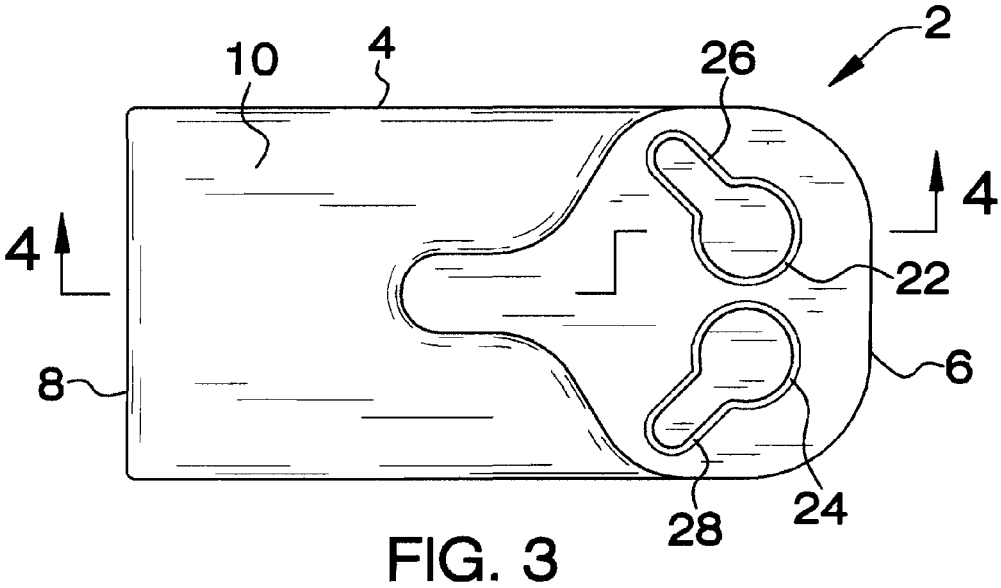
FIG. 3 shows a top view of the comfort device as it would appear in use.
Figure 4:
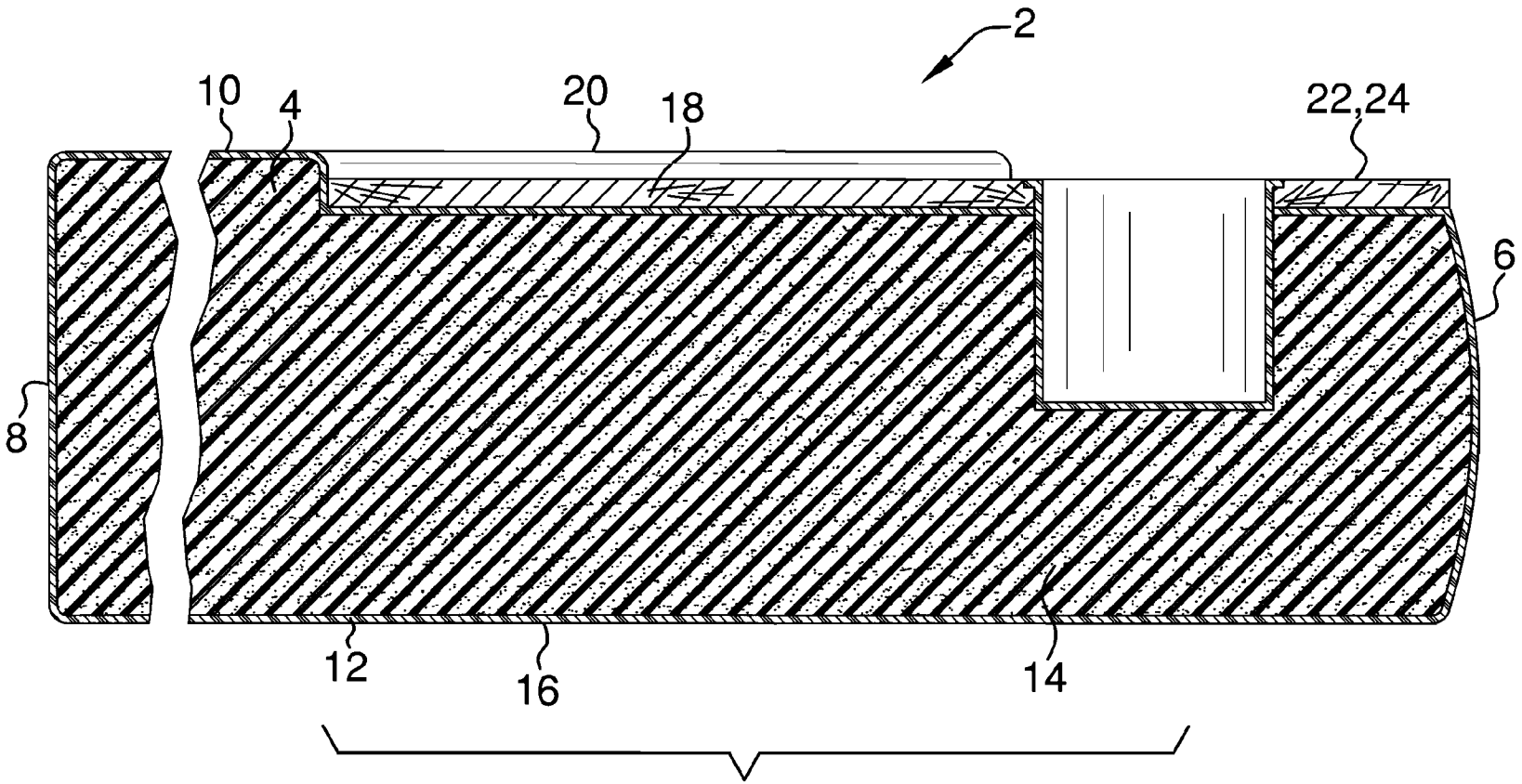
FIG. 4 shows a side cutaway view of the comfort device as it would appear in use.

With reference now to the drawings, and in particular to FIGS. 1 through 4 thereof, a new comfort device embodying the principles and concepts of the present invention and generally designated by the reference numeral 2 will be described.

As best illustrated in FIGS. 1 through 4, the comfort device 2 comprises a base 4 that has two ends comprising a first end 6 and a second end 8, and furthermore, has two surfaces comprising a top surface 10 and a bottom surface 12. The first end 6 of the base 4 has rounded corners, while the second end 8 of the base 4 has pointed corners and is flat. The first end 6 has rounded corners in order to provide comfort and ease of use, as this is the end that is direct proximity to an individual utilizing the comfort device 2. The second end 8 has flat corners and is flat, as this is the end of the comfort device 2 that is mostly likely to be placed flush against a bed headboard or other flat surface.

The base 4 itself is fabricated from a foam rubber interior 14 that is covered by a layer of nylon fabric 16 on the outside. The base 4 preferably has dimensions of 24 inches in length, 12 inches in width, and 6 inches in height.

On the top surface 10 of the comfort device 2 from the first end 6 to approximately halfway to the second end 8 of the comfort device 2 is located a layer of wood 18. On top of a portion of the layer of wood 18 is a layer of padding 20. The presence of the wood 18 and the padding 20 is to provide extra structural support for the comfort device while it is in use.

The comfort device 2 also has a pair of beverage holders 22 and 24 which are located on the portion of the layer of wood 18 that is not covered by padding 20. Each of the beverage holders 22 and 24, either alone or individually, are designed to allow an individual to place a beverage within it. The beverage holders 22 and 24 are preferably located adjacent to one another.

The comfort device 2 further comprises a pair of slots 26 and 28 which are located on the portion of the layer of wood 18 that is not covered by padding 20. Slot 26 is flush with beverage holder 22, while slot 28 is flush with beverage holder 24. Each of the slots 26 and 28 are ideally configured to hold a remote control, but alternatively, can be used to hold other items as well.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A comfort device comprising:

(a) a base having two ends comprising a first end and a second end, the base also comprising two surfaces comprising a first surface and a second surface, (b) means for allowing an individual to place beverages on the comfort device, and (c) means for allowing an individual to place objects within the comfort device adjacent to the location wherein the beverages are to be placed, wherein the comfort device is fabricated from a foam rubber interior;

wherein the foam rubber interior within the comfort device is covered by a layer of fabric;

wherein the comfort device further comprises a hard layer attached to a top surface of the comfort device; and wherein the hard layer attached to the top surface of the comfort device further comprises a layer of wood.

2. A comfort device according to claim 1 wherein the means for allowing an individual to place beverages on the comfort device further comprises (a) a pair of beverages holders located on the top surface of the base, the pair of beverage holders comprising a first beverage holder and a second beverage holder, (b) wherein the first beverage holder and the second beverage holder are located adjacent to one another.

3. A comfort device according to claim 2 wherein the means for allowing an individual to place objects within the comfort device adjacent to the location wherein the beverages are to be placed further comprises (a) a pair of slots located on the top surface of the base, the pair of slots comprising a first slot and a second slot, (b) wherein the first slot is flush with the first beverage holder, and (c) further wherein the second slot is flush with the second beverage holder.

4. A comfort device according to claim 3 wherein each of the slots of the pair of slots located on the top surface of the base are configured to hold a remote control.

5. A comfort device according to claim 3 wherein a layer of padding is located on the top of the layer of wood located on the top surface of the base, further wherein the padding is not located on the portion of the wood where the pair of beverage holders are located.

6. A comfort device according to claim 5 wherein the base has a length of twenty-four inches, further wherein the base has a width of twelve inches, and further wherein the base has a height of six inches.

7. A comfort device according to claim 6 wherein the first end of the base is generally rounded.

8. A comfort device according to claim 6 wherein the second end of the base is flat.

* * * * *